United States Patent [19]

Zimmer

[11] 3,949,667

[45] Apr. 13, 1976

[54] DYESTUFF APPLICATOR FOR SCREEN PRINTER

[76] Inventor: Peter Zimmer, Untere Sparcher 54, A6330 Kufstein, Austria

[22] Filed: Jan. 31, 1974

[21] Appl. No.: 438,261

[30] Foreign Application Priority Data

Feb. 9, 1973 Austria ..... 1207/73

[52] U.S. Cl. ..... 101/119; 101/120; 101/123; 101/124; 118/213; 118/406

[51] Int. Cl.[2] ..... B41F 15/40; B05C 3/20

[58] Field of Search ..... 101/114, 116, 119, 120, 101/123, 124, 157, 169, 366; 401/197; 118/406, 407, 410, 411, 412, 213; 137/625.32, 625.33; 251/144, 326, 327, 328, 329

[56] References Cited

UNITED STATES PATENTS

| | | | |
|---|---|---|---|
| 2,203,910 | 6/1940 | Issartel et al. | 101/120 X |
| 2,573,576 | 10/1951 | Klumb | 137/625.32 X |
| 2,576,848 | 11/1951 | Mercier et al. | 137/625.33 |
| 2,887,044 | 5/1959 | Smejda | 101/115 |
| 2,928,340 | 3/1960 | Stein et al. | 101/120 |
| 3,224,031 | 12/1965 | Leland | 401/197 |
| 3,677,369 | 7/1972 | Schramm | 251/144 X |

*Primary Examiner*—Edgar S. Burr
*Assistant Examiner*—R. E. Suter
*Attorney, Agent, or Firm*—Ernest G. Montague; Karl F. Ross; Herbert Dubno

[57] ABSTRACT

A dyestuff applicator, overlying an area of a movable printing screen through which dyestuff is to be fed to a substrate, comprises a horizontal supply tube which supports an axially extending dyestuff-distributing member with freedom of relative movement in a vertical axial plane of the tube. The distributing member, resting under pressure on the screen, forms a discharge slot communicating with the interior of the tube through a multiplicity of conduits closely spaced along the tube axis, the conduits being disconnectable from the slot with the aid of a slidable or rotatable shutter lodged in the distributing member and controlled by an external actuator mounted on the supply tube.

4 Claims, 6 Drawing Figures

DYESTUFF APPLICATOR FOR SCREEN PRINTER

FIELD OF THE INVENTION

My present invention relates to a dyestuff applicator for a printing machine, more particularly a screen printer in which an apertured printing screen overlies a substrate to be imprinted and is movable together with that substrate in a predetermined direction.

BACKGROUND OF THE INVENTION

In my copending application Ser. No. 426,909, filed 13 Dec. 1973, I have disclosed a printing machine of this type wherein a supply tube is horizontally disposed inside a cylindrical printing screen and supports a dyestuff applicator divided into two relatively vertically movable parts, i.e. a guide structure secured to the underside of the supply tube and an elongate distributing member carried on that structure. The distributing member forms an outlet for the dyestuff along a narrow zone which is centered on a vertical axial plane of the supply tube and which can thus move up and down, in response to irregularities in the underlying substrate, substantially independently of that tube. The movement of the distributing member can be restrained, however, by interposed springs supplementing the weight of the overlying body of liquid, as likewise disclosed in the copending application.

In another copending application, Ser. No. 538,560 filed on 6 Jan. 1975 as a continuation of an earlier application now abandoned (Ser. No. 348,703 filed 6 Apr. 1973), I have disclosed a dyestuff applicator of the general type described above wherein, in order to prevent drooling of dyestuff onto a printing screen during standstill, a shutter is interposed between the applicator and the screen surface for movement along the latter into and out of a flow-blocking position. Such a shutter, being independent of the applicator proper, requires separate mounting means for supporting it on the supply tube.

OBJECTS OF THE INVENTION

The general object of my present invention is to provide effective control means within the applicator itself for selectively blocking and unblocking the flow of dyestuff or the like from a supply tube to an outlet.

A more particular object is to provide convenient actuating means for displacing such control means from outside a printing machine of the character referred to.

SUMMARY OF THE INVENTION

In accordance with my present invention, a shutter common to a multiplicity of passages is movably held in the applicator, these passages connecting the interior of a supply tube with the outlet of an applicator mounted on the underside of that tube whereby a displacement of the shutter into a blocking position disconnects the outlet from the supply tube.

According to a more particular feature of my invention, the tube carries actuating means for the shutter which may include a servomotor connected with the shutter through a lever, if the shutter is slidable in the axial direction, or a shaft journaled on the tube and articulatedly connected with the shutter, if the latter is rotatable. In either case, the shutter may overlie a throughgoing flow-equalizing channel extending axially above the applicator outlet.

BRIEF DESCRIPTION OF THE DRAWING

The above and other features of my invention will now be described in detail with reference to the accompanying drawing in which.

SPECIFIC DESCRIPTION

Figure 1:
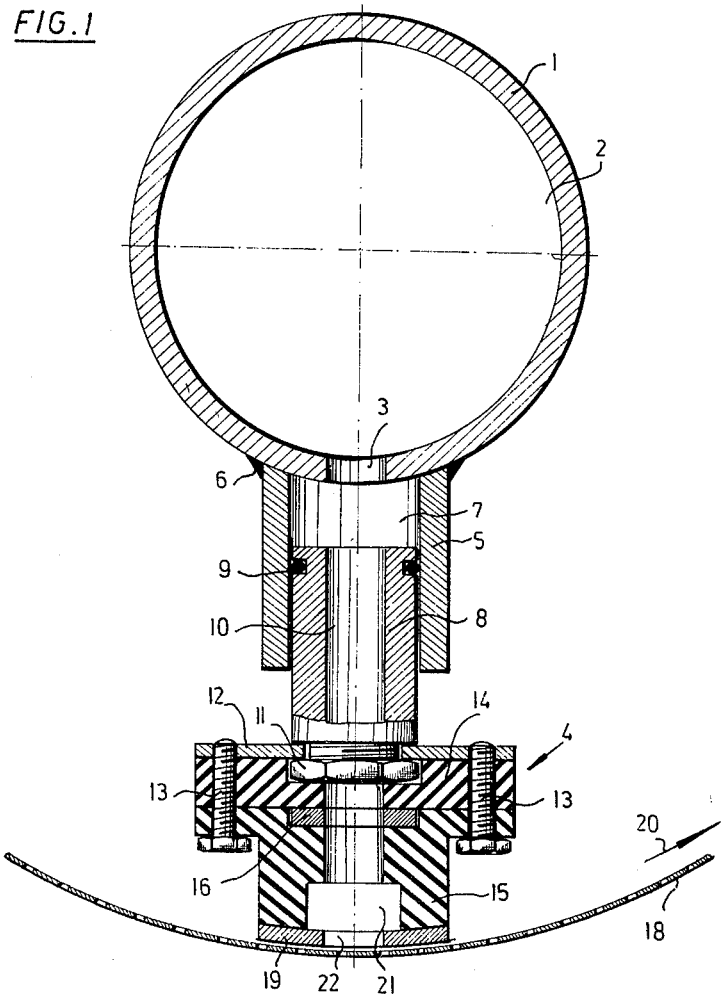
FIG. 1 is a cross-sectional elevational view of a dyestuff applicator embodying my invention.
Figure 2:
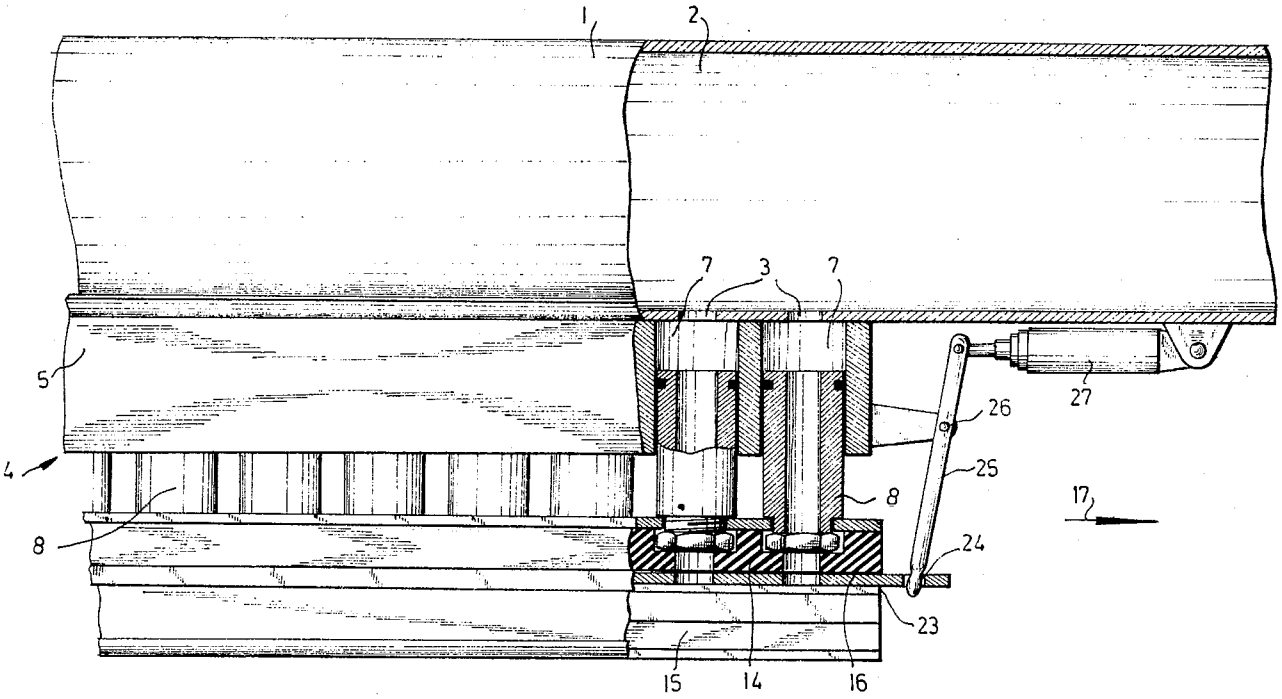
FIG. 2 is a fragmentary side-elevational view, partly in section, of the applicator shown in FIG. 1.

FIGS. 1 and 2 show a supply tube 1 whose interior 2 receives liquid dyestuff under pressure. The liquid flows through holes 3 on the lower tube surface into an applicator comprising a distributing member 4 and an associated guide beam 5 welded along seams 6 to the underside of tube 1. Vertical bores 7 in beam 5, spaced apart in the axial direction of the tube, form a multiplicity of cylinders for the guidance of respective pistons 8 which are sealed against the cylinder walls by means of O-rings 9. A center bore 10 in each piston 8 feeds the dyestuff to the lower part of the vertically slidable distributing member 4. The pistons 8 are attached by means of nuts 11 to a metal strip 12 which has apertures aligned with their center bores 10. The metal strip 12 is slightly flexible so as to be limitedly deformable in the axial direction.

Rubber profiles 14 and 15 are attached on the metal strip 12 by means of headed bolts 13. Between these two profiles there is located a flat slide 16 adapted to block the outflow of dyestuff from bores 10 upon being shifted in the axial direction 17. The two rubber profiles 14 and 15 are very flexible and can adapt well to shape changes of an apertured printing screen 18, contacting a nonillustrated web to be imprinted, as it rolls over uneven parts of that substrate. A thin supporting strip 19 is slidable with low friction at the foot of the applicator over the upper screen surface as the screen 18 moves in the direction 20. An axially extending channel 21 in profile 15 insures, downstream of shutter 16, equalization of the liquid dyestuff over the entire length of the applicator. The dyestuff exits through a narrower gap 22, aligned with equalizing channel 21, to reach the underlying substrate through the screen apertures.

One end of shutter slide 16 has a hole 24 into which is inserted an end of a lever 25 which is fulcrumed at 26 on the guide structure 5 and is swingable in a vertical plane by a pneumatic or hydraulic cylinder 27. Lever 25, constituting an articulated link between the shutter and the piston of cylinder 27, enables the shutter 16 to be moved in a blocking direction, arrow 17, or in an opposite unblocking direction. Of course, the shutter could also be actuated manually from the outside, via a suitable linkage, or by means of a screw. It is possible to couple the actuation of the shutter with the drive of the printing machine so that the outflow of dyestuff is blocked when the machine is at standstill.

Figure 4:
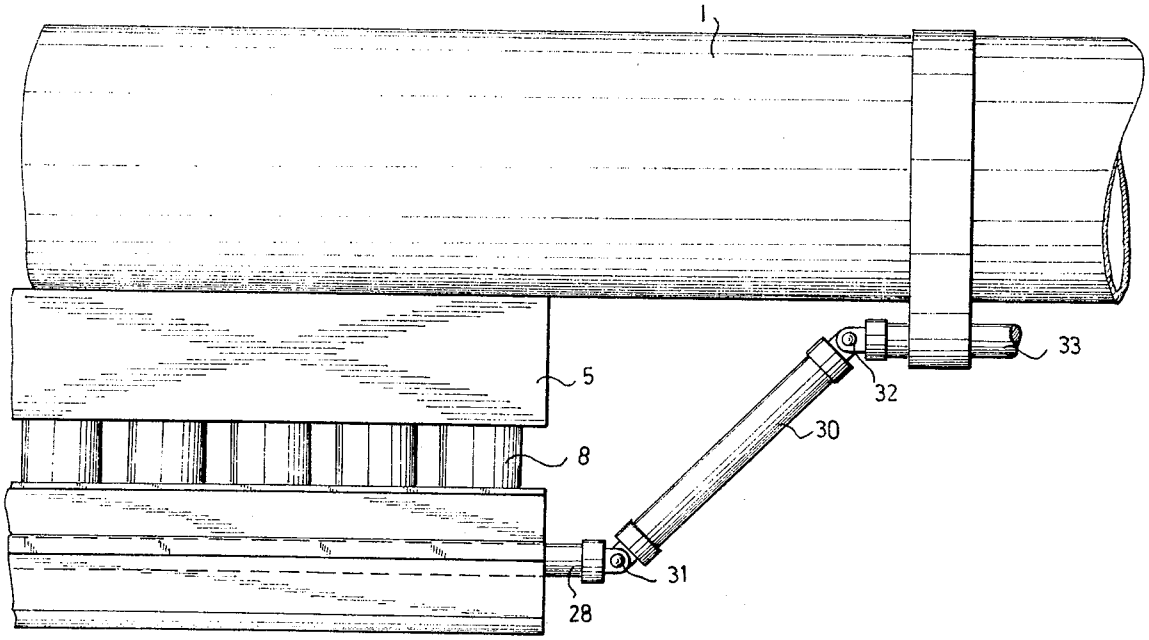
FIG. 4 is a view similar to FIG. 2 but relating to the modification of FIG. 3.
Figure 3:
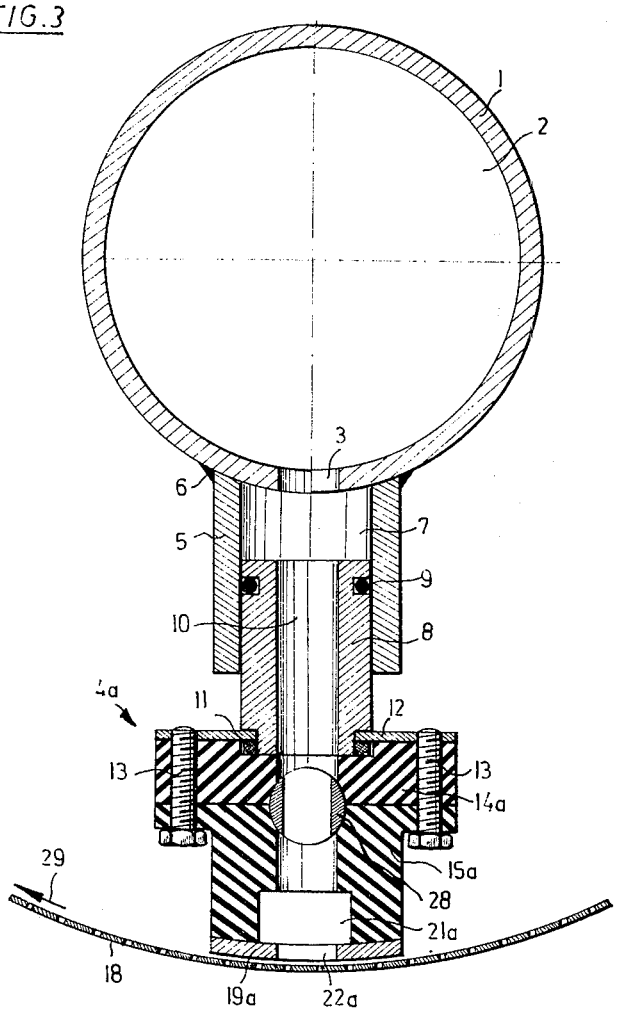
FIG. 3 is a cross-sectional view similar to FIG. 1, illustrating a modification.

In FIGS. 3 and 4 I have shown a generally similar applicator with a slightly modified distributing member **4*a* and a rotatable shutter rod 28 of circular cross-section lodged between rubber profiles 14***a* and 15*a*, replacing the slide 16. The flow paths 7, 10 are blocked upon rotation of the perforated rod 28 through 90°. Such rotation can be performed, via an articulated link in the form of a connecting shaft rod 30 and two universal joints 31 and 32, by a control shaft 33 which extends axially out of screen 18 and, like the cylinder 27 of FIG. 2, is mounted on the underside of supply tube 1.

Figure 5:
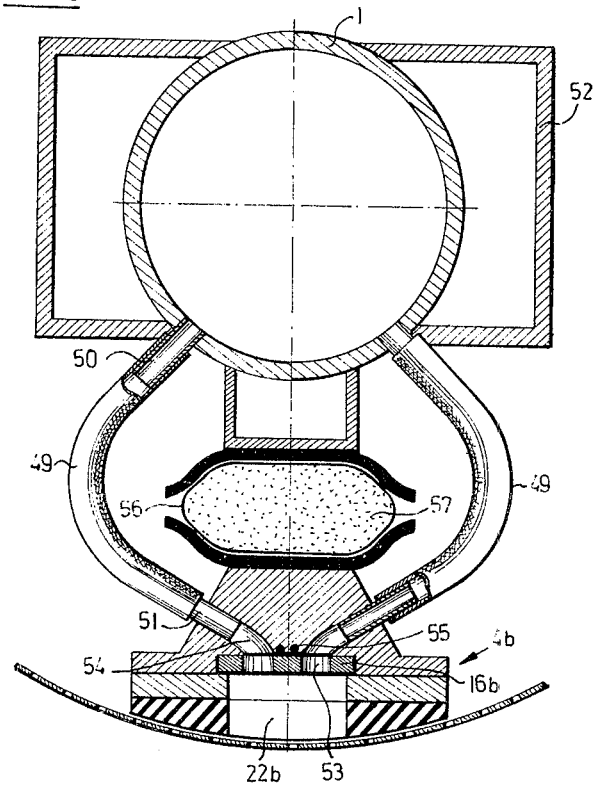
FIGS. 5 and 6 are further cross-sectional views, taken in different transverse planes, showing another embodiment of my invention.
Figure 6:
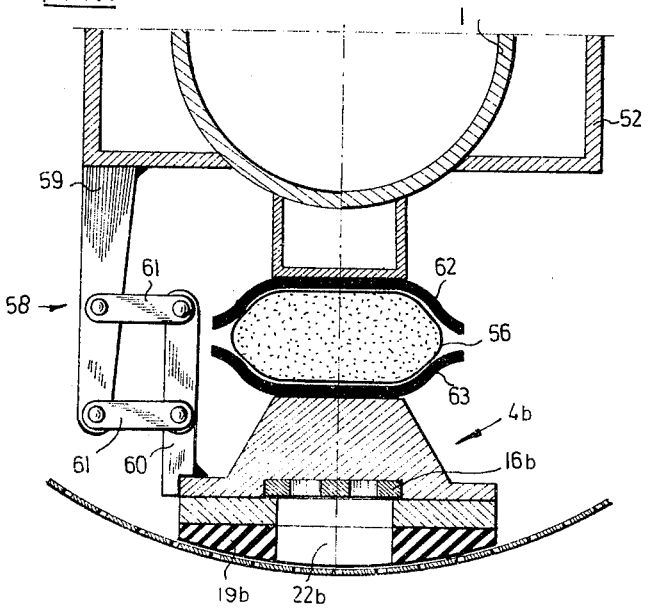

FIGS. 5 and 6 show a modified supply tube 1*b* with lateral ports carrying soldered or brazed nipples 50 connected via flexible hoses 49 with similar nipples 51 seated in ports 54 of a distributing member 4*b*. The tube 1*b* is provided with lateral C-profile reinforcements 52 which serve to stiffen it in a horizontal direction to minimize oscillations due to irregular flow. In member 4*b* there is again provided a shutter 16*b* in the form of a flat slide of steel or iron whose holes 53 control the flow of dyestuff to the discharge gap 22*b* by moving in a direction parallel to the axis of tube 1*b*. The holes 53 are divided into two groups lying on opposite sides on a centerline parallel to the tube axis.

In this embodiment the distributing member 4*b* is forced against the screen 18 by an elastic hollow body 56 filled with a pressure fluid 57 equalizing the unavoidable deformations which occur along the axis of tube 1*b* so as to relieve the member 4*b* of bending stress.

As shown in FIG. 6, member 4*b* is connected with tube 1*b* through one of its reinforcements 52 by means of a parallelogram linkage 58 to prevent any substantial tilting of that member from its illustrated position due to the forces acting on the applicator in operation. Naturally, a small angular play remains, on account of unavoidable manufacturing tolerances at the pivot points of the articulated linkage 58 consisting of vertical arms 59, 60 and horizontal links 61. The elastic hollow body or bladder 56 is so held between pressure plates 62 and 63 that the stress distribution is as even as possible. Liquids as well as gases can be employed as the pressure fluid. Gases have the advantage that a simple raising or lowering of tube 1*b* enables the contact pressure between member 4*b* and screen 18 to be varied, yet this in pressure follows a relatively steep characteristic. With a liquid pressure fluid the change in contact pressure is determined by a preferably elastic end mounting of tube 1*b*. Also here again a flat slide is provided on top of the gap 22. The cross-sectional view of FIG. 6 is taken in a plane different from that of FIG. 5, specifically in an end region, so that neither the conduits 49 nor the openings 53 are visible.

With the construction of FIGS. 1 and 3, too, the passages between the supply tube 1 and the outlet 22 can be designed as flexible conduits such as short rubber pipes rather than as bores 10 in rigid pistons 8. Furthermore, my invention is applicable to any treatment of a web-like substrate by liquid or pasty substances that must penetrate into that substrate at selected locations.

I claim:

1. In a printing machine, in combination:

an apertured screen overlying a substrate to be imprinted along a contact area, said screen and said substrate being movable in a predetermined direction;

a horizontal supply tube with an axis in a plane perpendicular to said predetermined direction, said tube being connected to a source of dyestuff and spacedly disposed above said contact area;

a dyestuff applicator including a guide structure secured to the underside of said tube and an elongate distributing member vertically movable within said guide structure in an axial plane of said tube, said distributing member forming an outlet for said liquid along a narrow zone of said contact area centered on said axial plane, said applicator forming a multiplicity of passages transverse to said axis connecting the interior of said tube with said outlet and terminating within said member in a common distributing channel paralleling said outlet and communicating therewith, said member resting on said screen in said contact area;

an elongate shutter common to all said passages extending parallel to said axis in said member between said passages and said channel; and actuating means for selectively displacing said shutter between a flow-blocking and an unblocking position, said actuating means comprising a control element mounted on said tube and an articulated link connecting said control element with said shutter while enabling vertical movement of said member with reference to said tube.

2. The combination defined in claim 1 wherein said channel is wider than said passages in a direction transverse said axis.

3. The combination defined in claim 1 wherein said shutter is axially slidable, said control element comprising a servomotor and said link being a lever fulcrumed on said guide structure.

4. The combination defined in claim 1 wherein said shutter is rotatable, said control element comprising a rotatable shaft parallel to said shutter, said link being a connecting rod universally jointed to said shaft and to said shutter.

* * * * *